US007452293B2

(12) United States Patent
Spiegel

(10) Patent No.: US 7,452,293 B2
(45) Date of Patent: Nov. 18, 2008

(54) APPLIANCE FOR CONTROLLABLY ALTERING THE TRAJECTORY OF A KICKED AMERICAN FOOTBALL

(76) Inventor: H. Jay Spiegel, P.O. Box 11, Mount Vernon, VA (US) 22121

( * ) Notice: Subject to any disclaimer, the term of this patent is extended or adjusted under 35 U.S.C. 154(b) by 584 days.

(21) Appl. No.: 10/747,179

(22) Filed: Dec. 30, 2003

(65) Prior Publication Data

US 2005/0143197 A1 Jun. 30, 2005

(51) Int. Cl.
*A63B 69/00* (2006.01)
*A63B 71/00* (2006.01)

(52) U.S. Cl. ..... 473/420; 473/422

(58) Field of Classification Search ..... 473/417–420, 473/422

See application file for complete search history.

(56) References Cited

U.S. PATENT DOCUMENTS 3,309,087 A * 3/1967 Cullity ..... 473/420
3,481,602 A * 12/1969 Tatter ..... 473/420
D275,303 S * 8/1984 Box, Sr. ..... D21/716
4,655,453 A * 4/1987 Spiegel et al. ..... 473/420
4,657,252 A * 4/1987 Spiegel ..... 473/420
D305,448 S * 1/1990 Spiegel ..... D21/716
5,100,135 A * 3/1992 Bourgeois ..... 473/420
D372,062 S * 7/1996 Spiegel ..... D21/716
5,613,678 A * 3/1997 McKee et al. ..... 473/397
D383,817 S * 9/1997 Spiegel ..... D21/716
D391,275 S * 2/1998 Spiegel ..... D15/135
D392,705 S * 3/1998 Spiegel ..... D21/716
5,961,402 A * 10/1999 Spiegel ..... 473/420
6,309,316 B1 * 10/2001 Spiegel ..... 473/420
D489,779 S * 5/2004 Spiegel ..... D21/716

* cited by examiner

*Primary Examiner*—Mitra Aryanpour
(74) *Attorney, Agent, or Firm*—H. Jay Spiegel

(57) ABSTRACT

A device for controllably altering trajectory of a kicked football includes a member removably insertable in a recess of a tee. The device is used in any one of three ways. First, it may be placed within the forward recess of the tee to combine with the ball receiving recess to completely enclose the tip of the football about its periphery. Second, a protrusion of the device may be placed in front of and slightly to the right of the centerline of the football. After the football is kicked, the tip of the football strikes this protrusion, causing the football to be deflected and to hook to the left. Third, the projection is in front of and slightly to the left of the centerline of the football. After the football is kicked, the tip strikes the projection, causing the ball to travel slightly to the right.

30 Claims, 4 Drawing Sheets

APPLIANCE FOR CONTROLLABLY ALTERING THE TRAJECTORY OF A KICKED AMERICAN FOOTBALL

BACKGROUND OF THE INVENTION

The present invention relates to a device or stationary body for controllably altering the trajectory of a kicked American football.

In the early 1960s, the art of soccer-style kicking was first used in an organized college football contest by Peter Gogolak when he played college football at Cornell University. Mr. Gogolak later had a distinguished career with the Buffalo Bills and New York Football Giants while his brother, Charlie, later played college football at Princeton University followed by a professional career with teams including the Washington Redskins. Beginning in the late 60s, Jan Stenerud began his lengthy and successful career in the National Football League as a soccer-style kicker initially playing for the Kansas City Chiefs. His distinguished career earned him a spot in the National Football Hall of Frame, the first place kicker to be inducted whose only position was place kicker. Other place kickers who also prominently played other positions are also members of that exalted Hall. Lou Groza (who also was an All-Pro offensive tackle) and George Blanda (who was also an All-Pro quarterback) are the two most prominent examples.

In performing a soccer-style kick, the kicker approaches the ball from an angle as compared to the straight-on technique in which the kicker approaches the ball from directly behind it. Recognizing, this difference, Stenerud sought to develop a football tee that was particularly designed to permit effective soccer-style kickoffs. These efforts resulted in the issuance of U.S. Pat. Nos. D269,890, D277,973 and 4,418,910. Each of these patents teaches a particular orientation of upstanding prongs allegedly designed to support the football for a soccer-style kick while substantially avoiding striking of the prongs by the kicker's foot.

Invariably, contrary to the intent of the tees disclosed in the Stenerud patents a place kicker kicking a football off a Stereud tee would strike one or more of the prongs with their foot, an instant before striking the ball, thereby slightly dislodging the ball from the tee an instant before impact on the ball by the kicker's foot. As a result, the ball's orientation would be slightly altered from its orientation when first placed on the tee, thereby precluding the kicker from causing the football to travel with a uniform backward end-over-end spin. Instead, invariably, the ball would not be ideally struck. Instead, it would be struck in a manner causing the ball to flutter in an unplanned an unintended way, and with a trajectory that was unpredictable, and for a distance significantly shorter than that which was intended due to less than ideal contact with the ball.

In the early 1980's , H. Jay Spiegel began developing a line of football place kicking tees, all of which had the common characteristic of eliminating the use of prongs to support the football. Instead, each of these tees includes the characteristic of a ball receiving recess that supports the tip of the football with a surface contact and with the recess being forwardly open to allow the football to be kicked fromn the recess when impacted by the kicker's foot.

One important improvement resulting from the Spiegel tees is that, invariably, the place kicker, whether using the conventional-style or soccer-style technique, strikes the football directly without first striking the tee, thereby permitting the kicker to cleanly kick the football on its "sweet spot," as intended, thereby causing the football to travel down field, as intended, with a lazy backward end-over-end spin. As a result, the average length of kickoffs has dramatically increased over the past several years as more and more kickers have begun using the Spiegel tees that are marketed under the Trademarks TOE-TAL® and GROUND ZERO®. As of the date of filing of this application and for preceding several years, every NFL® kicker uses Spiegel's 1" GROUND ZERO® tee. Spiegel has been awarded numerous U.S. patents as well as corresponding foreign patents for the Spiegel tees. The U.S. patents include U.S. Pat. Nos. 4,655,453; 4,657,252; D291,714; D305,448; D372,062; D383,816; D383,817; D392,705; and 6,309,316.

While the Spiegel GROUND ZERO® and TOE-TAL® tees permit the place kicker to cleanly strike the football with his or her foot, sometimes a kicker wishes to engage in trickery in an attempt to fool the receiving team as to the trajectory, location and spin that the football will engage in while traveling through the air down the field. The GROUND ZERO® ONSIDE™ tee, covered by U.S. Pat. No. 6,309,316, includes a peripheral forward notch designed to support the football with its tip on the ground and leaning against the side wall of the tee to enhance the reproducibility of onside and squib kicks. This tee was first used in the 2004 Gator Bowl. While the additional notch in the GROUND ZERO® ONSIDE™ tee effectively supports the football for onside and squib kicks, it would be desirable if an additional feature could be employed to permit controllable adjustment of the trajectory and spin of the football without advance warning being given to the receiving team. It is with this thought in mind that the present invention was developed.

SUMMARY OF THE INVENTION

The present invention relates to a device or stationary body for controllably altering the trajectory of a kicked American football. The present invention includes the following interrelated objects, aspects and features:

(1) In a first aspect, the present invention contemplates, in one preferred embodiment thereof, a molded member or device or stationary body designed to be removably insertable in the forward recess included in the GROUND ZERO® and TOE-TAL® tees. That recess is provided to permit the typical football to leave the tee unimpeded when it is struck by the place kicker's foot. Of course, the inventive member or device or stationary body may be made through a technique other than molding such as, for example, being cut from a solid piece of material or any other desired method of fabrication. It may also be employed placed in front of a football that is not supported by a tee.

(2) In the preferred embodiment of the present invention, the inventive device or stationary body may be used in any one of three different ways. In a first orientation, for example, placed within the forward recess of the tee, the device or stationary body has a recess that combines with the ball receiving recess to completely enclose the tip of the football about its periphery. In that configuration of the device or stationary body, when the ball is normally struck, instead of flying out of the tee with a lazy backward end-over-end spin, instead, the football travels down the field at a lower altitude with a forward end-over-end spin.

(3) In a second orientation of the inventive device or stationary body, a protrusion is placed in front of and slightly to the right of the centerline of the football, looking forward from the rear of the football, when it is placed within the associated tee. After the football is kicked, the tip of the football strikes this protrusion as it leaves the tee causing the football to be deflected to the left, thereby causing the football to hook to the left as it flies through the air.

(4) In the third mode of use of the device or stationary body, it is, for example, placed within the forward recess in an orientation in which the projection is in front of and slightly to the left of the centerline of the football as it is placed in the tee. In this orientation, after the football is kicked, the tip strikes the projection on the way out of the tee causing the ball to travel slightly to the right in a slicing trajectory as it travels down the field.

(5) The device or stationary body is configured to be completely received within the forward recess of the tee and, as such, is not visible to the players on the receiving team who are no closer than 10 yards away at the time the football is kicked as required by the rules of the game at every level, whether amateur, high school, college or professional. Thus, while the players on the kicking team are made aware of the intended trajectory of the football, the receiving team players are not. Thus, the kicking team is better able to plan for coverage of the kickoff in an attempt to "pin" the receiving team down deep in their own end of the field. For example, if the device or stationary body is placed in the forward recess of the tee so the result will be a hook of the ball toward the left, the players on the kicking team are apprised of this plan and can better adjust their coverage to attempt to pin the receiving team down in the corner of the field where the ball will travel, unbeknownst to the receiving team.

(6) Through practice, the kicker can perfect his kicking technique to the point where the trajectory of the football is that much more predictable.

As such, it is a first object of the present invention to provide a device or stationary body for controllably altering the trajectory of a kicked American football.

It is a further object of the present invention to provide such a device or stationary body in which the appliance is placed within the forward recess of an existing football tee.

It is a still further object of the present invention to provide such a device or stationary body in which several alternative portions or structures may be oriented facing a ball receiving recess of such a football tee to effectuate planned adjustment of the trajectory of a ball kicked therefrom.

It is a still further object of the present invention to provide such a device or stationary body in which one structure or portion thereof causes the football to travel down the field in a forward spinning flight.

It is a still further object of the present invention to provide such a device or stationary body in which the football is controllably caused to travel in a hooked trajectory.

It is a still further object of the present invention to provide such a device or stationary body in which the football is controllably caused to travel in a slicing trajectory.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
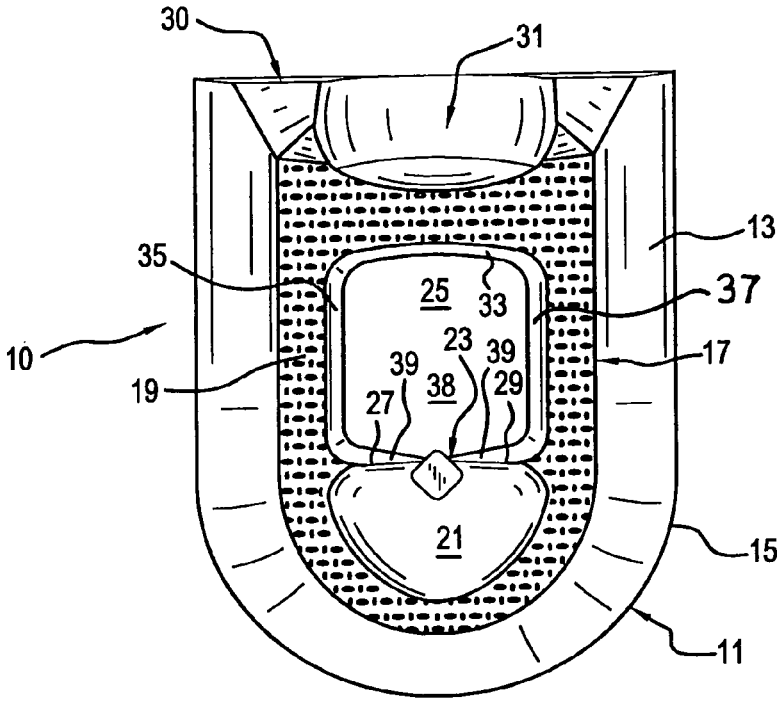
FIG. 1 shows a top view of a football kicking tee of the general type with which the present invention is intended to be used in a preferred embodiment thereof.
Figure 2:
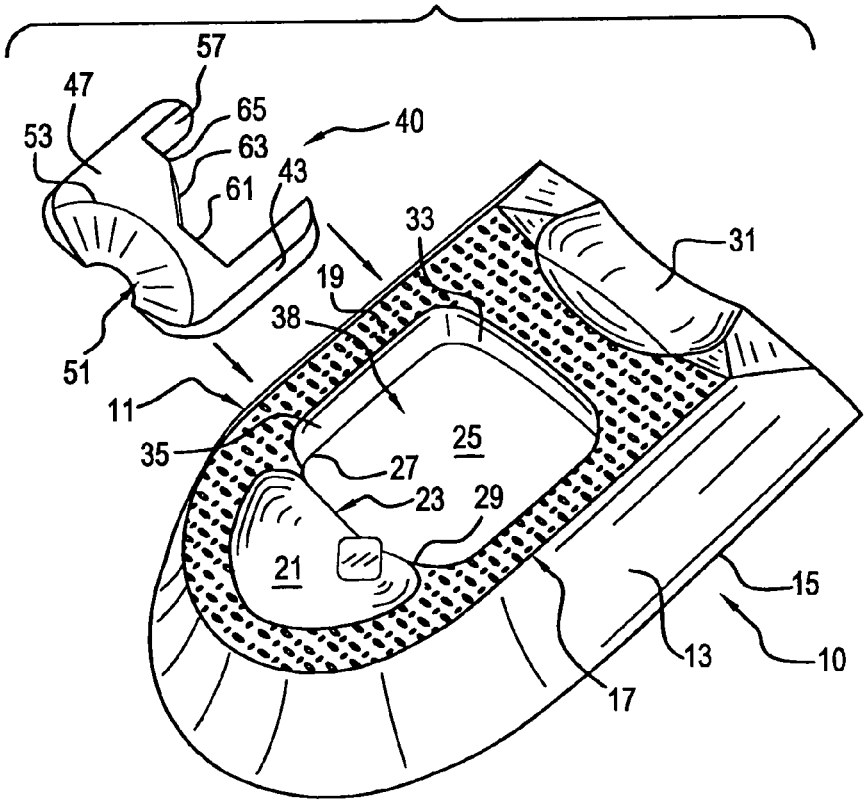
FIG. 2 shows an exploded perspective view of the tee of FIG. 1 and the inventive device or stationary body.

With reference, first, to FIGS. 1 and 2, a football tee of the general type that is most prominent in the game of American football as played as of the date of filing of this patent application is generally designated by the reference numeral 10, and includes a tee body 11 with a peripheral skirt 13 extending from a bottom periphery 15 to a top periphery 17 that also comprises the outer periphery of a top surface 19 shown as having a roughened surface configuration provided for ornamental purposes.

With further reference to FIGS. 1 and 2, depending downwardly from the top surface 19 of the tee 10 is a ball receiving recess 21 shaped in partial conformance to the shape of a tip of an American-style football and connected through an opening 23 with a forward recess 25 provided to permit a football placed in the recess 21 to cleanly leave the tee 10 without obstruction from any structure of the tee. Inwardly facing ribs 27 and 29 help to hold the football (not shown) within the recess 21, but do not substantially impede the football's departure from the recess 21 when kicked.

The football tee shown in FIG. 1 and 2 also includes an auxiliary recess 31 consisting of a notch at the forward end 30 of the tee 10 and shaped to mimic the side surface of a football adjacent its tip. The recess or notch 31 is designed to permit a football (not shown) to be supported with the tip of the ball on a ground surface and the side wall of the football leaning against the notch 31. In this configuration, support of the football for onside kicks and squib kicks is enhanced.

A football tee corresponding to that which is depicted in FIGS. 1 and 2 is covered by the claims of U.S. Pat. No. 6,309,316 and will be used for the first time in organized football games in the year 2004. By contrast, the football tee known as the GROUND ZERO®-1 that is currently used by every NFL team and in most major college programs is covered by a number of U.S. Patents as listed hereinabove in the BACKGROUND OF THE INVENTION section of the present application but most closely resembles that which is depicted in U.S. Pat. No. D383,816 issued Sep. 16, 1997.

With further reference to FIGS. 1 and 2, the forward recess 25 includes a forward wall 33, side walls 35 and 37, and a rear wall 39 that is discontinuous and formed by the forward facing surfaces of the ribs 27 and 29. The recess 25 also includes a bottom surface 38.

With particular reference, now, to FIGS. 2-8, the present invention will now be described in detail.

Figure 3:
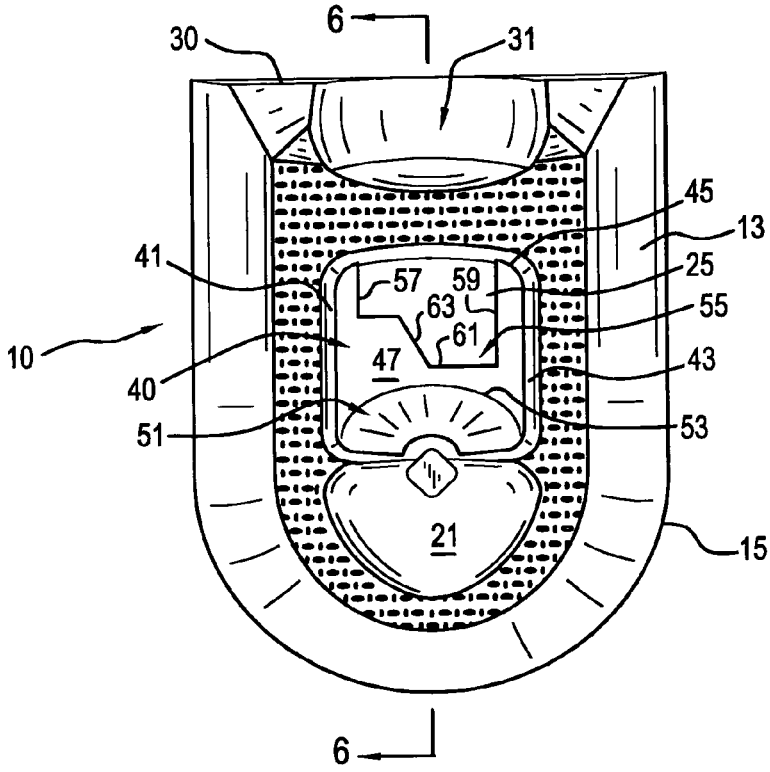
FIG. 3 shows a top view of the tee of FIGS. 1 and 2 with a device or stationary body in accordance with the teachings of the present invention received within the forward recess thereof in a first orientation.
Figure 4:
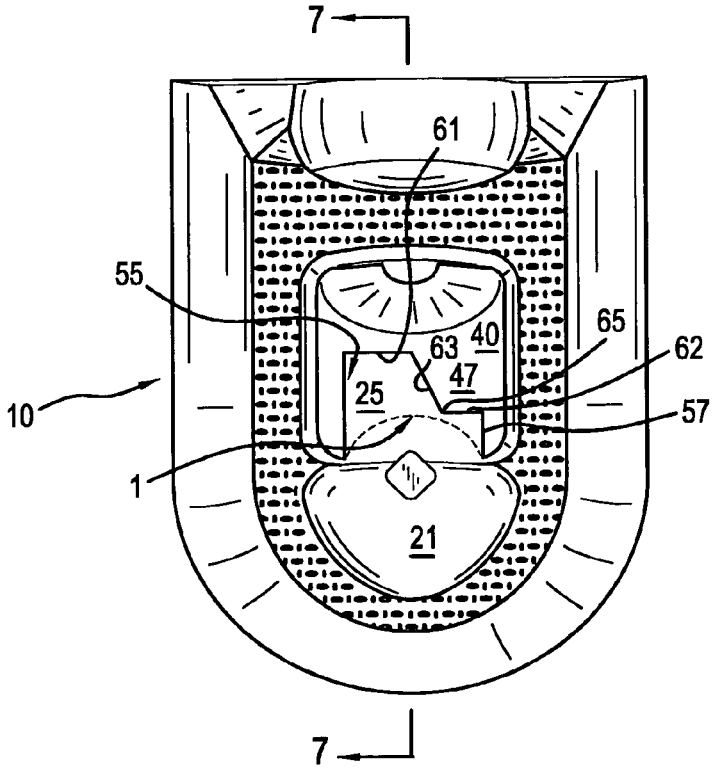
FIG. 4 shows the tee of FIGS. 1 and 2 with the device or stationary body of the present invention received within the forward recess thereof in a second orientation.
Figure 5:
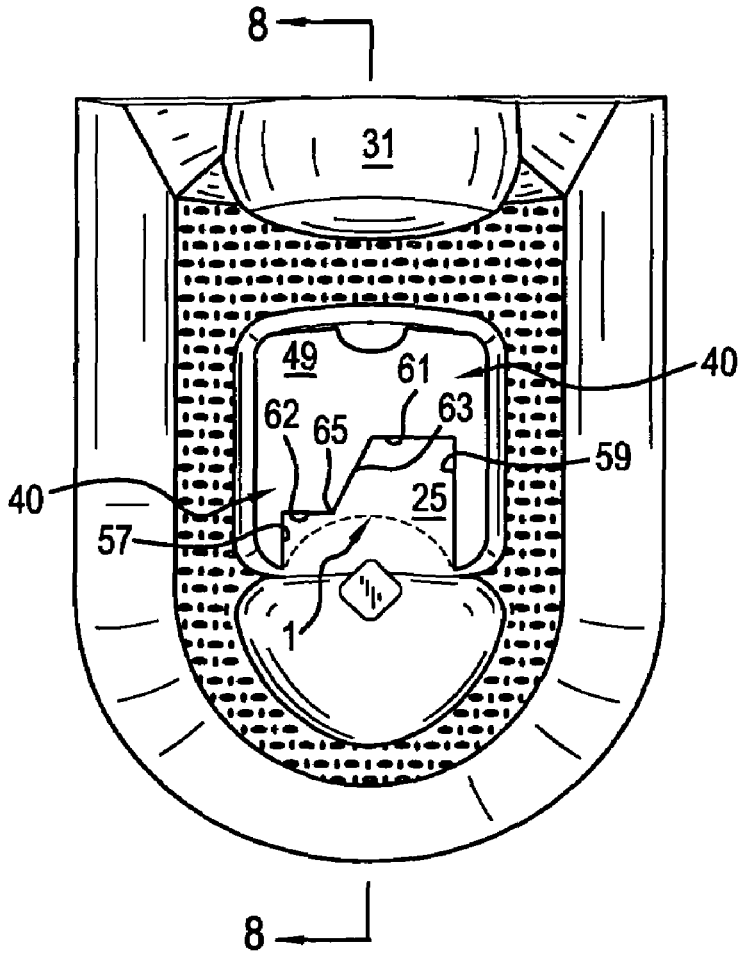
FIG. 5 shows the tee of FIGS. 1 and 2 with the device or stationary body in accordance with the teachings of the present invention received within the forward recess thereof in a third orientation.

The inventive device or stationary body is generally designated by the reference numeral 40 and, as best seen in FIGS. 2-5, is sized to be received within the forward recess 25 of a football tee such as that which is designated by the reference numeral 10 in the drawing figures. Preferably, the device or stationary body 40 includes sides 41, 43 and 45 that are configured to be frictionally received by the side walls 33, and 37 of the recess 25 to releasably retain the device or stationary body 40 therein regardless of the orientation of the device 40 or stationary body. As seen in FIGS. 3-5, any one of three different orientations of the device or stationary body 40 effectuate the purposes of the present invention.

With reference, again, to FIG. 3, it is seen that the device or stationary body 40 includes a first surface 47 and, with reference to FIG. 5, a second surface 49, with the surfaces 47 and 49 preferably lying in parallel planes. In the orientation of the device or stationary body 40 of FIGS. 3 and 4, the surface 47 comprises a top surface and the surface 49 comprises a bottom surface. In the orientation of the device or stationary body 40 depicted in FIG. 5, the surface 49 consists of an upper surface and the surface 47 comprises a lower surface.

Figure 6:
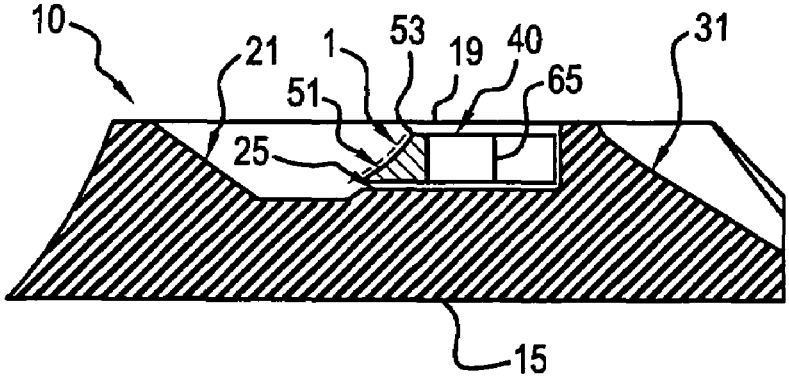
FIG. 6 shows a cross-sectional view along the line 6-6 of FIG. 3.

With reference back to FIG. 3, the device or stationary body 40 has an arcuate recess 51 having an arcuate periphery 53 and, with reference to FIG. 6, has a shape designed to conform with the tip of a football (not shown) when the football is placed within the ball receiving recess 21. As should be understood with reference to FIGS. 3 and 6, when the device or stationary body 40 is in the configuration shown in those figures, when a football tip is placed within the recess 21 and enclosed by the recess 51, the forward recess 25 of the tee 10 is not operable in the manner intended when the device or stationary body 40 is not inserted therein as is the case with regard to FIGS. 1 and 2. In the configuration of the device or stationary body 40 shown in FIGS. 3 and 6, a football may not frictionally be kicked out of the recess 21 without striking some structure since the surface 51 of the device or stationary body 40 provides a structure that impedes the football from leaving the tee 10 when the device or stationary body 40 is placed within the recess 21 thereof.

As should be understood by those of ordinary skill in the art, with the device or stationary body 40 in the configuration shown in FIGS. 3 and 6, when a football is placed within the recess 21 and the tip thereof is enclosed by the recess 51, after the football is kicked, instead of leaving the tee 10 with a lazy backward end-over-end spin, instead, enclosure of the tip thereof causes the football to leave the tee with a forward spinning lower trajectory.

With further reference to FIG. 3, the device or stationary body 40 also includes an additional recess 55 including side walls 57 and 59, laterally extending walls 61 and 62, angled wall 63, and projection 65 at the intersection of the walls 62 and 63. These walls are provided for purposes to be described in greater detail hereinafter.

Figure 7:
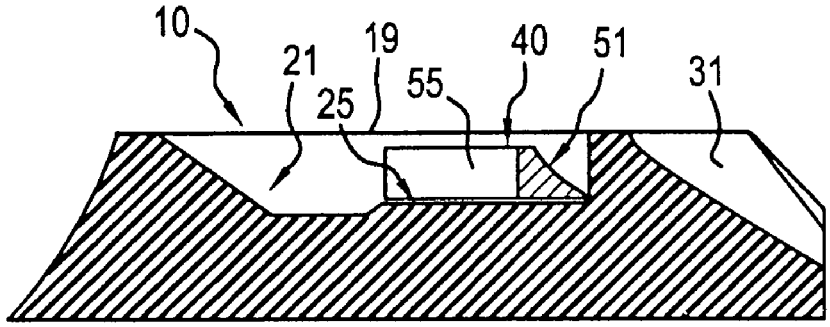
FIG. 7 shows a cross-sectional view along the line 7-7 of FIG. 4.

In this regard, reference is now made to FIGS. 4 and 7 in which the device or stationary body 40 has been rotated 180 degrees from its configuration shown in FIGS. 3 and 6 and now the recess 55 faces the recess 21 of the tee 10. As seen in FIG. 4, the intersection 65 between the walls 63 and 62 of the device or stationary body 40 comprises a projection that lies immediately adjacent the peripheral surface of a football (shown in a phantom line designated by the reference numeral 1) when the football is placed within the ball receiving recess 21 of the tee 10. Thus, with the device or stationary body 40 in the configuration shown in FIGS. 4 and 7, an instant after the football is struck by the kicker, the peripheral surface 1 hits the projection 65 which is just to the right of the centerline of the football in the rearward to forward direction. This causes the football to be deflected leftward in the view of FIG. 4 as it leaves the tee 10 via the forward recess 25. This deflection causes the football to hook leftward as it travels down the playing field.

Figure 8:
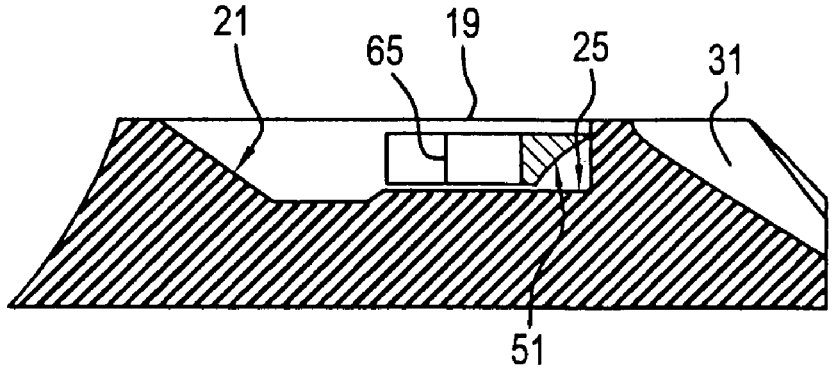
FIG. 8 shows a cross-sectional view along the line 8-8 of FIG. 5.

With reference, now, to FIGS. 5 and 8, it is seen that the device or stationary body 40 has been flipped over from its configuration shown in FIGS. 4 and 7 so that the projection 65 is now slightly to the left of the rearward to forward centerline of the football and immediately adjacent to the peripheral surface 1 of the football depicted in phantom lines in FIG. 5. Thus, in the configuration of the device or stationary body 40 as shown in FIGS. 5 and 8, when the football is kicked, an instant after the kicker's foot strikes the ball, the peripheral surface 1 of the football engages the projection 65 and is deflected in the right-hand direction in the view of FIG. 5, thereby causing the ball to slice rightward as it travels down the field.

As understood from FIGS. 7-8, the height of the device or stationary body 40 is no greater than the depth of the recess 25 so that the device or stationary body 40 is not visible above the tee 10 once it is inserted into the recess 25. Thus, the receiving team which is no closer than 10 yards from the tee cannot see in which orientation the device or stationary body 40 has been placed within the recess 25 and, thus, cannot tell at which trajectory the kicker intends to kick the football.

Through use of the present invention, a kicker may predictably adjust the trajectory of a football that is to be kicked from a tee without the receiving team being aware of which trajectory has been chosen while the players on the kicking team are fully aware of the chosen trajectory to enhance their ability to effectively cover the kickoff.

As such, an invention has been disclosed in terms of a preferred embodiment thereof which fulfills each and every one of the objects of the invention as set forth hereinabove, and provides a new and useful device or stationary body for controllably altering the trajectory of a football of great novelty and utility.

The invention claimed is:

1. A device for controllably altering a trajectory of a kicked American football, comprising:

a) a stationary body received on a tee in front of an American football, said football supported on said tee in an orientation permitting said football to be kicked by a kicker's foot;

b) said stationary body having a portion located such that after said football is kicked, said football strikes said portion and is deflected into a substantially predictable trajectory; and c) said tee having a recess shaped generally in conformance with a shape of a tip of an American football, said football having a tip releasably received within said recess.

2. The device of claim 1, wherein said recess comprises a first recess, said tee having a second recess connected to and forward of said first recess.

3. The device of claim 2, wherein said stationary body is removably received within said second recess.

4. The device of claim 3, wherein said second recess has side walls at least as tall as a vertical thickness of said stationary body.

5. The device of claim 1, wherein said portion of said stationary body comprises a recess shaped partially in conformance with a shape of a tip of an American football.

6. The device of claim 3, wherein said portion of said stationary body comprises a further recess shaped partially in conformance with a shape of a tip of an American football, said further recess and first recess combining to substantially circumferentially enclose said football tip.

7. The device of claim 1, wherein said portion of said body comprises a rearward facing projection located slightly left of a centerline of said football when looking forward from a rear of said football.

8. The device of claim 1, wherein said portion of said body comprises a rearward facing projection located slightly right of a centerline of said football when looking forward from a rear of said football.

9. The device of claim 1, wherein said portion of said stationary body comprises:

a) a further recess shaped partially in conformance with a shape of a tip of an American football, said further recess and first recess combining to substantially circumferentially enclose said football tip; and b) a projection which in a first orientation of said stationary body is slightly left of a centerline of said football when looking forward from a rear of said football, and in a second orientation of said stationary body is slightly right of said centerline.

10. The device of claim 9, wherein said further recess faces said tee recess in a third orientation of said stationary body.

11. A device for controllably altering a trajectory of a kicked American football, comprising:

a) a stationary body placed at a fixed location in front of an American football, said football supported by a support structure in an orientation permitting said football to be kicked by a kicker's foot;

b) said stationary body having a portion spaced apart from said support structure including being spaced apart from any portion of said support structure between said football and said stationary body, said stationary body being located such that after said football is kicked, a surface of said football spaced from said support structure strikes said portion and is deflected into a substantially predictable trajectory.

12. The device of claim 11, wherein said football is supported on a tee.

13. The device of claim 12, wherein said stationary body is received on said tee.

14. The device of claim 13, wherein said tee has a recess shaped generally in conformance with a shape of a tip of an American football, said football having a tip releasably received within said recess, said recess comprising said support structure.

15. The device of claim 14, wherein said recess comprises a first recess, said tee having a second recess connected to and forward of said first recess.

16. The device of claim 15, wherein said stationary body is removable received within said second recess.

17. The device of claim 16, wherein said second recess has side walls at least as tall as a vertical thickness of said stationary body.

18. The device of claim 11, wherein said portion of said stationary body comprises a recess shaped partially in conformance with a shape of a tip of an American football.

19. The device of claim 16, wherein said portion of said stationary body comprises a further recess shaped partially in conformance with a shape of a tip of an American football, said further recess and first recess combining to substantially circumferentially enclose said football tip.

20. The device of claim 11, wherein said portion of said stationary body comprises a rearward facing projection located slightly left of a centerline of said football when looking forward from a rear of said football.

21. The device of claim 11, wherein said portion of said stationary body comprises a rearward facing projection located slightly right of a centerline of said football when looking forward from a rear of said football.

22. The device of claim 14, wherein said portion of said stationary body comprises:

a) a further recess shaped partially in conformance with a shape of a tip of an American football, said further recess and first recess combining to substantially circumferentially enclose said football tip; and b) a projection which in a first orientation of said stationary body is slightly left of a centerline of said football when looking forward from a rear of said football, and in a second orientation of said stationary body is slightly right of said centerline.

23. The device of claim 12, wherein said further recess faces said tee recess in a third orientation of said stationary body.

24. In a football tee having a recess shaped generally in conformance with a shape of a tip of an American football, the improvement comprising a device for controllably altering a trajectory of a football kicked from said recess, comprising:

a) a stationary body placed at a fixed location in front of said football supported in said recess;

b) said stationary body having a portion spaced apart from said recess, including being spaced apart from any portion of said recess between said football and said stationary body, said stationary body being located such that after said football is kicked, a surface of said football spaced from said recess strikes said portion and is deflected into a substantially predictable trajectory.

25. The tee of claim 24, wherein said recess comprises a first recess, said tee having a second recess connected to and forward of said first recess; said stationary body being removably received within said second recess.

26. The tee of claim 25, wherein said portion of said stationary body comprises a further recess shaped partially in conformance with a shape of a tip of an American football, said further recess and first recess combining to substantially circumferentially enclose said football tip.

27. The tee of claim 25, wherein said portion of said stationary body comprises a projection located slightly left of a centerline of said football when looking forward from a rear of said football.

28. The tee of claim 25, wherein said portion of said stationary body comprises a projection located slightly right of a centerline of said football when looking forward from a rear of said football.

29. The tee of claim 24, wherein said portion of said stationary body comprises:

a) a further recess shaped partially in conformance with a shape of a tip of an American football, said further recess and first recess combining to substantially circumferentially enclose said football tip; and b) a projection which in a first orientation of said stationary body is slightly left of a centerline of said football when looking forward from a rear of said football, and in a second orientation of said stationary body is slightly right of said centerline.

30. The tee of claim 29, wherein said further recess faces said tee recess in a third orientation of said stationary body.

* * * * *